US010352617B2

(12) United States Patent
Millan et al.

(10) Patent No.: US 10,352,617 B2
(45) Date of Patent: Jul. 16, 2019

(54) APPARATUS AND METHOD FOR PURIFYING GASES AND METHOD OF REGENERATING THE SAME

(71) Applicants: QUANTUM DESIGN INTERNATIONAL, INC., San Diego, CA (US); UNIVERSITY OF ZARAGOZA, Zaragoza (ES); CONSEJO SUPERIOR DE INVESTIGACIONES CIENTIFICAS, Madrid (ES)

(72) Inventors: Conrado Rillo Millan, Zaragoza (ES); Jost Diederichs, Poway, CA (US); Michael Bancroft Simmonds, Bozeman, MT (US)

(73) Assignees: UNIVERSITY OF ZARAGOZA, Zaragoza (ES); QUANTUM DESIGN INTERNATIONAL, INC., San Diego, CA (US); CONSEJO SUPERIOR DE INVESTIGACIONES CIENTIFICAS, Madrid (ES)

( * ) Notice: Subject to any disclaimer, the term of this patent is extended or adjusted under 35 U.S.C. 154(b) by 779 days.

(21) Appl. No.: 14/496,821

(22) Filed: Sep. 25, 2014

(65) Prior Publication Data

US 2016/0091245 A1 Mar. 31, 2016

(51) Int. Cl.
*F25J 3/08* (2006.01)
*F25J 3/06* (2006.01)

(52) U.S. Cl.
CPC ..... *F25J 3/08* (2013.01); *F25J 3/069* (2013.01); *F25J 2205/20* (2013.01);
(Continued)

(58) Field of Classification Search
CPC ..... F25J 2205/20; F25J 2205/84; F25J 2270/908; F25J 3/08; F17C 2227/0353
See application file for complete search history.

(56) References Cited

U.S. PATENT DOCUMENTS 5,111,667 A * 5/1992 Hafner ..... F04B 37/08 417/901
5,243,826 A * 9/1993 Longsworth ..... F17C 6/00 237/2 B (Continued)

FOREIGN PATENT DOCUMENTS

JP 646656 A 1/1989
JP 04064869 A 2/1992

(Continued)

OTHER PUBLICATIONS

Espacenet English translation of JP2001248964A. Jun. 2018.*

(Continued)

*Primary Examiner* — Tareq Alosh
(74) *Attorney, Agent, or Firm* — Stetina Brunda Garred and Brucker; Mark B. Garred

(57) ABSTRACT

A method and device for purifying a process gas mixture, such as a cryogen gas, in which impurity components of the mixture are removed by de-sublimation via cryo-condensation. The gas mixture is cooled to a temperature well below the condensation temperature of the impurities, by direct exchange of the gas mixture with a cooling source disposed in a first region of the device. The de-sublimated or frozen impurities collect about the cooling region surfaces, and ultimately transferred to a portion of the device defining an impurities storage region. The output-purified gas is transferred from the impurities storage region, is optionally passed through a first micrometer sized filter, through a counter-flow heat exchanger, and ultimately up to an output port at room temperature. A method of purging the collected impurities and regenerating the device is also disclosed.

12 Claims, 11 Drawing Sheets

(52) U.S. Cl.
CPC ..... *F25J 2205/84* (2013.01); *F25J 2270/908* (2013.01); *F25J 2290/20* (2013.01); *F25J 2290/70* (2013.01)

(56) References Cited

U.S. PATENT DOCUMENTS

| | | | | |
|---|---|---|---|---|
| 5,653,889 | A * | 8/1997 | Buchanan | B01D 17/0202 210/777 |
| 6,082,133 | A * | 7/2000 | Barclay | B01D 53/002 62/619 |
| 2002/0000096 | A1* | 1/2002 | Trembley | B01D 7/02 62/637 |
| 2009/0266088 | A1* | 10/2009 | Oikawa | B01D 8/00 62/55.5 |
| 2011/0162391 | A1* | 7/2011 | Ball-DiFazio | F04B 37/08 62/55.5 |
| 2014/0090404 | A1 | 4/2014 | Simmonds et al. | |

FOREIGN PATENT DOCUMENTS

| | | | |
|---|---|---|---|
| JP | 04064869 | U | 6/1992 |
| JP | 04064869 | B | 10/1992 |
| JP | 2001248964 | A | 9/2001 |
| JP | 2010189245 | A | 9/2010 |
| JP | 2011132064 | A | 7/2011 |

OTHER PUBLICATIONS

Japanese Office Action for JP2014-262714 dated Dec. 8, 2015.
European Search Report for EP 14 19 6895 dated Feb. 5, 2016.
J. Diederich, C. Chialvo, M. Simmonds, Cryo-Cooled Low Pressure Helium Purifier, Abstract, 2012, 4 Pages, Boulder, CO.
Canadian Office Action for CA Application No. 2,899,802, dated Aug. 25, 2016.
Japanese Office Action for JP Application No. 2014-262714, dated Oct. 18, 2016.
European Examination Report for EP14 196 895.8; dated Feb. 28, 2018.
Chinese Office Action for CN 201510089174.4; dated Jul. 25, 2018.

* cited by examiner

APPARATUS AND METHOD FOR PURIFYING GASES AND METHOD OF REGENERATING THE SAME

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field of the Invention

The present invention relates to cryogen gas purifiers for removing impurities from a supply of cryogen gas, and more particularly to helium gas purifiers configured to de-sublimate impurities by cryo-condensation that, optionally, utilize filter means for further facilitating removal of such impurities. The invention further includes methods for purging such impurities or otherwise regenerating the purifiers for continuing operation.

2. Description of the Related Art

Cryogen gases are in high demand for their application in refrigeration and cooling technologies, as well as other applications. For example, helium gas, among other cryogen gases, is often used in a variety of medical and scientific equipment, including magnetic resonance imaging (MRI), material analysis devices, and other equipment. To achieve liquid-phase helium for use with refrigeration technologies, gas-phase helium is generally liquefied within a gas liquefier by cooling the gas to a point of liquefaction. The liquid-phase helium is then evaporated to produce a flow of gas-phase helium for cooling material samples, superconducting magnets, or other materials or components.

Due to the scarcity of helium, as well as the high consumption of the cryogen gas, there is much interest in the recovery of the evaporated liquid from medical and scientific equipment that is afterwards purified and liquefied to be used again. For example, apparatuses such as magneto encephalography (MEG), nuclear magnetic resonance (NMR), physical properties measurement systems (PPMS), and magnetic properties measurement systems (MPMS), among others, can consume from 1 to 10 L/day of liquid helium.

When the overall consumption of a facility, such as a hospital or scientific laboratory, is below 100 L/day, conventional helium recovery and liquefaction practices (i.e., those based on the pioneering work of Professor Samuel C. Collins and derived technologies), are too big and inefficient due to a significant amount of the evaporated helium that is lost into the atmosphere. As an alternative, there is presently an emerging commercially-available technology, based on cryocoolers, for recovery and liquefaction at the small scale (<100 L/day), which adapts liquefaction to consumption and maintains the liquid produced without losses until a transfer to the liquid helium user equipment is needed. Exemplary systems that are currently available include helium liquefiers produced by Quantum Design of San Diego, Calif.; Cryomech of Syracuse, N.Y.; and Quantum Technology of Blaine, Wash. Such technology is proving to be sufficient for helium recovery of single, as well as for multiple, medical and scientific instruments so that helium losses could be minimized.

While the liquefaction technology of small scale helium recovery systems based on cryocoolers works properly when using commercial-grade, high purity gas where total impurities concentrations are less than 1 in volume ppm, the efficiency is immediately lost when using recovered gas having impurity concentrations greater than 1 ppm in volume. For the recovery of helium from single or multiple medical and scientific instruments, however, the necessary purification technology prior to liquefaction (i.e., producing pure gas at a level of <<1 ppm total impurity content) is not efficient enough.

In order to provide sufficiently purified gas to a liquid helium plant or system, there is thus typically deployed a gas purifier that is operative to remove impurities in the incoming feed gas. In this regard, gas purification is a separation process whose sole purpose is removal from the process gas of unwanted traces, or small amounts of contaminants, termed impurities. After purification, the purified cryogen gas is removed (e.g., transferred to liquefier), the separated contaminants are discarded and the device used for purification is regenerated for re-use.

Currently, three different gas purification methods are being used in conjunction with Small Scale Helium recovery plants. Those methods are as follows:

1. Chemical Gas Adsorption: The gaseous helium mixture is brought in contact with a solid product, the getter, at high temperatures. The impurities (mainly $N_2$ and $O_2$ for the case of recovered helium) are eliminated by a chemical reaction with the getter to a level of $10^{-3}$ ppm, independently of their concentration in the input gas. The main limitation with this methodology is the maximum amount of impurities of the recovered gas at the input of the device, which has to be maintained below 10 ppm in volume, to avoid excessive heat generated by the very high exothermic chemical reactions with the impurities. However, most of the recovery systems, especially those using gasbags, in a best case scenario, have a minimum volume ratio concentration of $1.5\times10^{-4}$ in total. Therefore, this technique cannot be applied for purposes of the present invention. This technique also produces an undesirable increase of pressure drop as a function of the amount of reacted product, reaching several bar even at low flow rates (<10 sL/min) that further makes such method impractical for low-pressure recovery systems (e.g., <2 bar).

2. Cryogenic Gas Adsorption: The gaseous helium mixture is brought into contact with a material that has a high surface to volume ratio, then cooled to low temperatures of around 80 K using liquid nitrogen as a cooling agent. Since this is a surface effect, big volume ratios of the adsorption material versus the impurities present in the incoming gas are needed in order to be effective. When the adsorption material gets saturated, the system has to be heated at high temperature and regenerated by pumping. Therefore, twin systems are necessary for continuous operation, as well as liquid nitrogen refill operations to provide the required subsequent cooling. Moreover, the impurities concentration of the output gas often depends on the impurities concentration at the input. In this regard, output concentration levels below $10^{-5}$ are not easily achievable.

3. Cryo-condensation: Purification by cryo-condensation is accomplished by bringing in a phase change of the impurities sought to be removed. Cooling the incoming feed gas by means of refrigeration in a device at low temperatures (T<30 K for the case of nitrogen in helium) facilitates condensation of readily condensable impurities. As soon as the mixture gets supersaturated, the corresponding impurity de-sublimates and coats the cold surfaces of the container and/or precipitates out from the feed gas. That is, as soon as the mixture temperature reaches the value at which the equilibrium vapor pressure of the impurity is less than the impurity partial pressure in the mixture, the impurity starts to de-sublimate. Total $N_2$ and $O_2$ output impurity levels of 0.1 ppm or less in helium, when working at low pressures (<2 bar) and low temperatures (<30 K), are easily achievable. Even though there are already some advances on this kind of method using a device with a two stage cryocooler, continuous operation during long periods (months) while keeping operational flow rates of the order of 30 L/min in the process gas are still a challenge.

An exemplary prior art system for removing impurities from a helium feed gas is described in U.S. patent application Ser. No. 13/937,186, entitled CRYOCOOLER-BASED GAS SCRUBBER, filed on Jul. 8, 2013, which is based on cryo-condensation and/or coalescence of impurities on a very high effective coalescent/de-sublimation surface area material. The disclosed system uses a purifier cartridge filled with glass wool, occupying almost the entire Dewar impurities storage region, in order to get less than $5\times10^{-6}$ of $N_2$ with a maximum flow rate of 25 L/min. This limitation is due to the fact that as soon as the cooling device (a two stage refrigerator coldhead) and the surface of the corresponding output gas counter flow heat exchanger are coated by frost, not all the impurities are frozen and trapped on the deep cooling region but rather are forced to "coalesce" in contact with a high surface material, like glass wool that is densely packed inside a cartridge occupying the impurities storage volume. The main drawbacks of that system are as follows:

1. The impurities storage effective volume is only a small fraction of the Dewar volume, typically 10%, and thus can only provide a limited impurity storage capacity.

2. Both the Dewar neck and the Dewar belly, having small passages for the input gas flow, are easily blocked by frost. To minimize this drawback, a minimum flow back to the recovery system of around 5 L/min has to be maintained at all times, even when the liquefiers are not demanding any gas flow.

3. Periodic regenerations are required, typically once a week, which necessitates heating up the whole system (i.e., coldhead, heat exchanger, cartridge, Dewar belly) to above 120-150 K, and evacuating it completely.

4. The densely-packed filter cartridge represents a thermal load that makes the cool-down process after regeneration take a minimum of 3-6 hours, thus interrupting the liquefaction process during that additional time.

Accordingly, there is a substantial need in the art for methods and devices for purifying a process gas mixture that is exceptionally effective and efficient in removing impurities from the gas mixture that is also operative to provide a large volume to store impurities and can further eliminate the need for frequent regeneration processing. Along those lines, there is a need for such a system and method, as well as a method to efficiently regenerate such a system to thus enable cryogen gas purification to operate continuously without interrupting the supply of purified gas for prolonged periods of time (e.g., months). There is especially a need for such a system that can accomplish such objectives that is specifically tailored to helium recovery systems whereby adequate volumes of cryogen gas can be purified in a highly effective and economical manner.

BRIEF SUMMARY OF THE INVENTION

The present invention specifically address and alleviates the aforementioned deficiencies in the art. In this regard, there is disclosed a method and device to purify a gas mixture, and, more specifically, to purify recovered cryogen gas, namely helium gas, prior to liquefaction, whereby the purified gas contains impurities up to the order of $10^{-3}$ ppm in total volume ($N_2$, $O_2$, $CO_2$, CnHm).

To that end, the method and apparatus of the present invention are operative to remove the impurity components of the mixture via de-sublimation by cryo-condensation. The apparatus preferably comprises a vertically-oriented housing, and more particularly a vertically-oriented Dewar having an inlet for receiving the gas to be purified and a purified gas outlet. The Dewar includes an interior that defines a plurality of zones, including first and second zones defined by the upper interior within the Dewar within which is positioned a cooling device operative to cool down the incoming cryogen gas to be purified and causes such impurities to de-sublimate. Towards the bottom of the interior of the vertically-oriented Dewar is a third zone which is operative to define an impurities storage area whereby de-sublimated impurities are isolated and thus extracted from the cryogen gas sought to be purified. Within the third zone of the Dewar is a collection device or mechanism fluidly connected to the purified gas outlet that can include a filter mechanism, preferably in the form of a cartridge containing a thin layer or layers of nylon or metallic mesh, whereby purified helium gas is recovered. To effectuate greater purification of the cryogen gas, the filter mechanism is provided to prevent any de-sublimated or liquefied impurities from becoming reintroduced into the cryogen gas stream.

In use, the incoming gas mixture sought to be purified is cooled down well below the condensation temperature of the impurities by direct exchange of the gas mixture with a cooling device, typically a refrigerator coldhead, that is placed in the first zone of the vertically-oriented Dewar (i.e., in the Dewar neck). As the gas pre-cools from room temperature towards a temperature at which the equilibrium vapor pressure is less than the partial pressure of a given impurity in the gas mixture, the impurities progressively condense. Finally, at a certain temperature unique to the impurity (i.e. at the vapor-solid saturation temperature of the impurity at a pressure equal to its partial pressure in the mixture), the impurity de-sublimates. In this respect, frost is formed at a position in the apparatus at which the partial pressure of the impurity exceeds the saturation pressure. Thickness of the frost decreases rapidly even if the temperature further drops.

Deep cooling of the gas mixture initially takes place in this first zone on the gas process flow direction, also referred to as the de-sublimation region. The de-sublimated or frozen impurities first coat the surfaces of the cooling device, as well as the inner Dewar wall and the surfaces of the different elements in the first and second zones, which can also include further elements such as a gas exhaust heat exchanger, heater, and thermometer. Frost formed from the impurities typically grows up in the first and second zones defining the de-sublimation region, and may form blocks of frozen impurities and/or precipitate down into the third zone or region of the Dewar in the direction of the process gas flow, namely, the Dewar bottom, whereby the third zone or region thus defines an impurities storage region of the purifying apparatus.

The exhaust-purified gas is taken from the bottom of the third zone or impurities storage region through a collection mechanism, such as a funnel, font or other type device that optionally include a filter, a counter-flow heat exchanger, and up to the output port formed atop of the Dewar at room temperature. The filter for micrometer sized particles of frozen impurities avoids possible dragging of solid impurities and frost at high flow rates.

The method further contemplates a "soft" regeneration process whereby the cooling device disposed within the Dewar is periodically stopped, preferably automatically (i.e., once a day), and a first heater found on the surface of a heat exchanger positioned within the de-sublimation region of the Dewar is activated until a thermometer placed at the lower end of the cooling device indicates that the highest sublimation temperature of the specific impurities has been reached (e.g., 100 K for the case of He with $O_2$ and $N_2$ as the main contaminants). The frozen impurities are sublimated/liquefied and displaced from the first and second zones of the deep cooling region down into the impurities storage region where the impurities are frozen again as soon as they find the de-sublimation temperature condition at some point in the Dewar bottom. Such regeneration process is done well prior to when the Dewar neck could get clogged and/or before the heat exchange efficiency could be substantially reduced by the frost. Such impurity sublimation-displacement process advantageously takes only about 10-60 minutes and can preferably be automatically performed without interrupting the process gas flow, thus maintaining near full performance at any time until the impurities storage volume gets full.

Over time, when the third zone or impurities storage area become sufficiently filled with de-sublimated impurities, or when the aforementioned "soft" regeneration process does not sufficiently eliminate blockages that could occur from the de-sublimated impurities, the apparatus is further preferably provided with a second heater disposed in the third zone, and preferably at the Dewar bottom, that is operative to sublimate, liquefy and evaporate the stored impurities in such zone or impurity storage region. Such second heater, in contrast to the first heater discussed above, is thus provided for a standard high temperature (150 K) regeneration that complements the regeneration provided by the first heater or the "soft" regeneration process.

The concentration of a given impurity in the output gas is directly related to the ratio between the equilibrium vapor pressure of the solid impurity at the lowest temperature it has attained in its path through the entire device and the input gas mixture working pressure. Thus, the residual output impurities concentration do not depend on their concentration in the input gas mixture, hence values of the order of $<<0.1$ ppm are easily obtained. The method has been applied successfully to purify recovered helium gas from scientific and medical equipment prior to liquefaction using small-scale liquefiers like the commercial ATL helium liquefaction technology utilized by Quantum Design Inc. of San Diego, Calif. A prototype conforming to the embodiments disclosed herein has been feeding three Quantum Design, Inc.'s ATLs 160 liquefaction systems without interruption for high temperature regeneration during several months of operation.

It is thus a principal object of the present invention to provide a method of purifying a gas mixture, and particularly a helium gas mixture, by a freezing-out process whereby disadvantages of earlier processes and apparatus for this purpose can be obviated.

It is also an object of this invention to provide an apparatus for de-sublimation and trapping of gas impurities at cryogenic temperatures from a given gas mixture in which the advantages of the improved method are attained.

It is yet another object of this invention to provide a method and an apparatus for the freezing-out of the impurity components of a gas mixture so that the device can operate for especially long periods of time and, moreover, can operate with a negligible output volume concentration of the total impurities ($<10^{-9}$) in the output purified gas.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE INVENTION

The detailed description set forth below is intended as a description of the presently preferred embodiment of the invention, and is not intended to represent the only form in which the present invention may be implemented or performed. The description sets forth the functions and sequences of steps for practicing the invention. It is to be understood, however, that the same or equivalent functions and sequences may be accomplished by different embodiments and that they are also intended to be encompassed within the scope of the invention.

Figure 1A:
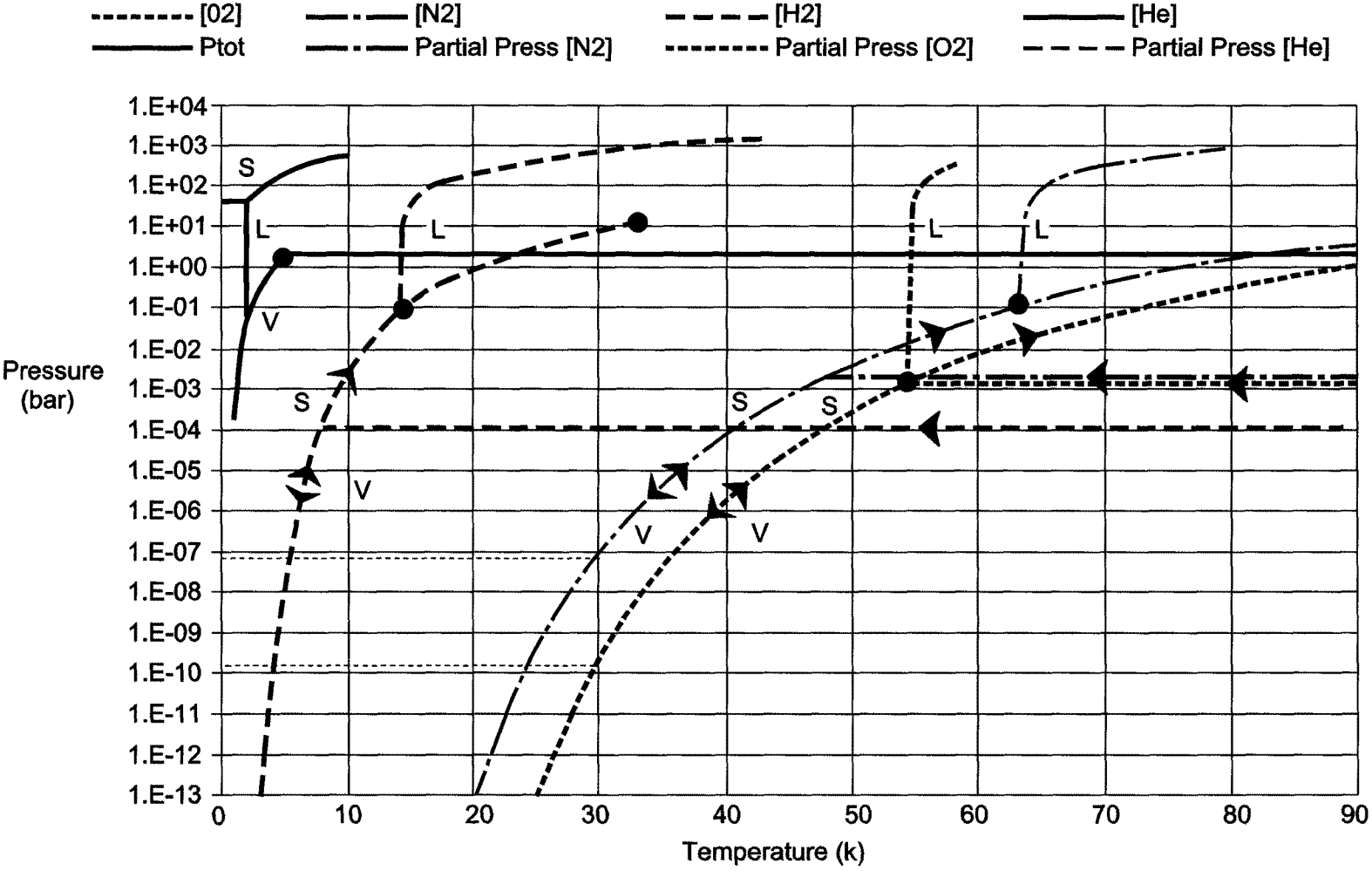
FIG. 1A is a pressure-temperature phase diagram, at constant volume, for helium (He), nitrogen ($N_2$), oxygen ($O_2$) and hydrogen.
Figure 1B:
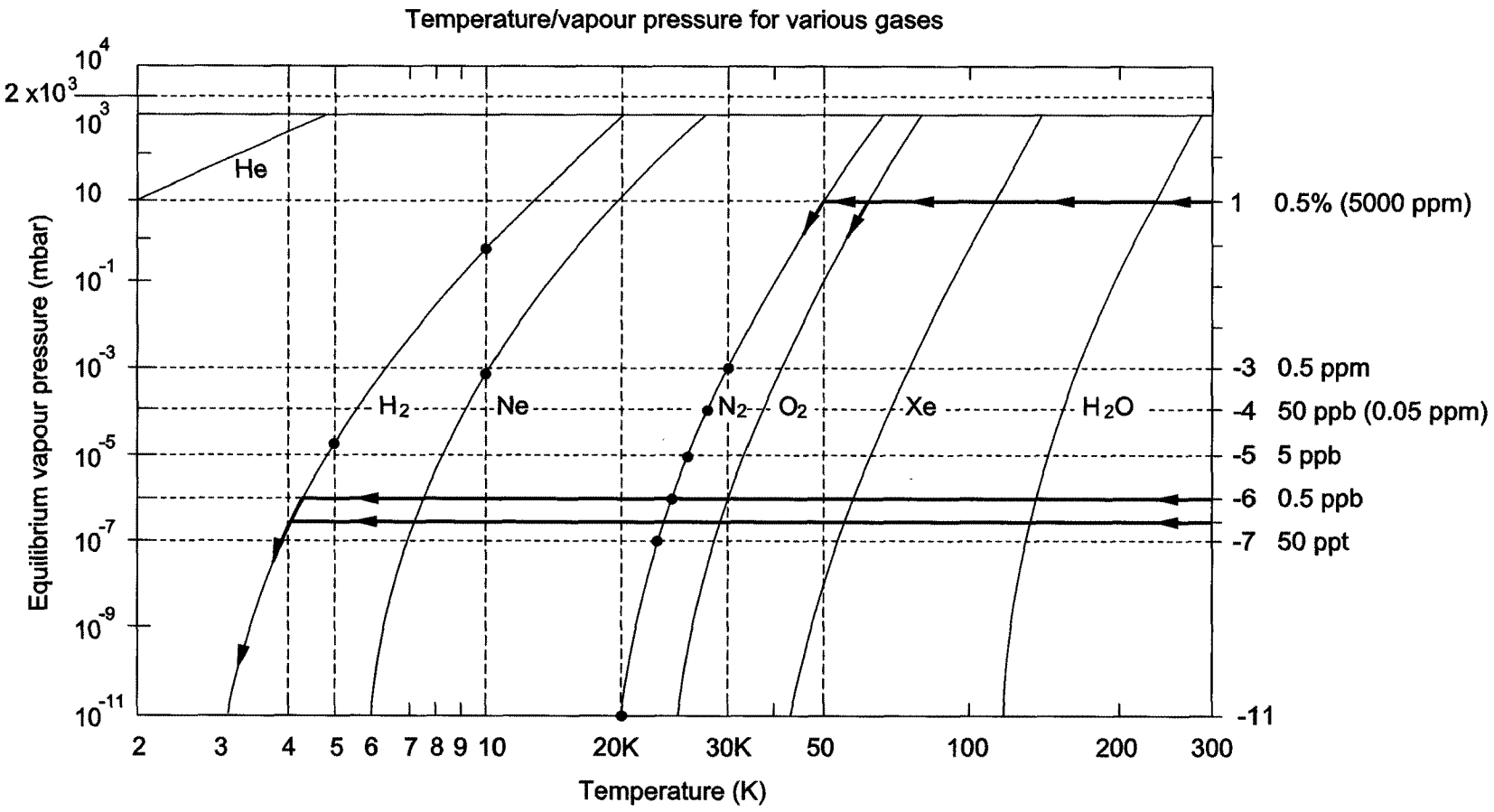
FIG. 1B is a pressure-temperature phase diagram similar to FIG. 1A but corresponding to a particular case of FIG. 1A for a working pressure of 2 bar absolute that includes water, Xe and Ne, and including a scale on the right side thereof specifying the volume concentration of a given impurity at each temperature.

Bearing the foregoing in mind, the present invention is directed to methods and devices for purifying a process gas mixture (i.e., cryogen gas) in which the gaseous impurity components of the mixture are removed by de-sublimation. In this regard, the working principle of this invention is cryo-condensation, which is a method well-known in the art to essentially freeze-out undesired components (i.e., impurities) from a given gas mixture by cooling down the mixture well below the condensation temperature of the impurities sought to be removed. FIG. 1 depicts a pressure-temperature phase diagram for a helium gas mixture having impurities of $N_2$, $_2$ and $H_2$.

Considering that the initial molar fraction, $Y_j$, at Room Temperature (RT), of an impurity represented by the index "j" in the gas mixture, can be approximated by the ratio of its partial pressure, $P_j$, to the total pressure of the mixture, $P_m$ (the approach is valid for ideal gases or small molar fractions), $$Y_j = \frac{P_j}{P_m}$$

The partial pressure of a frozen impurity at any temperature below its condensation temperature, $T_{cj}$, that is, for any $T<T_{cj}(P_j)$, is given by the vapor pressure of the condensate at T; in other words, it can be represented by the solid line separating Vapor (V) and Solid (S) phases for the specific impurity. As illustrated in FIG. 1, the continuous lines correspond to the saturation V-S, V-L lines for each component, the total Pressure (P) of the mixture being typically 2 bar. The respective dashed lines with the arrows indicate the partial pressure of the respective components of the mixture during their cool down. When a given component reaches the de-sublimation V→S line, then it follows this continuous line, decreasing with T, and does not leave this line when heating up until all the frozen mass becomes vapor, or liquid first and then vapor, depending on total condensed amount of the impurity. As will be appreciated, $Y_j(T)$ dramatically decreases by orders of magnitude once the sublimation (V→S) line is reached and T is further decreased.

Thus, for helium (He) at room temperature and 2 bar having small volume concentrations (<1% in total) of mainly $N_2$ and $O_2$ after cool down of the mixture below 30 K, the concentration of $O_2$ and $N_2$ in the gas phase will be reduced to below 0.5 ppm and to negligible values once the mixture is cooled below 20 K.

In the example illustrated in FIG. 1, the dashed lines, with their corresponding arrows, indicate the Pj-T trajectory of the vapor phase for each component, ($j=N_2, O_2, H_2$), during initial cool down. It is an isobaric process until the temperature reaches the condensation (de-sublimation) value of the given component. Then, when the sublimation S-V saturation line is reached, the impurities are immediately frozen and their corresponding partial pressures on the mixture are determined by the vapor pressure of the condensates. Further decreasing of the temperature dramatically reduces the vapor pressure of the frozen impurity.

The same principles also apply with respect to purging or removing the collected de-sublimated impurities. In this context, and after a certain time frozen impurities are accumulated, the system is heated for regeneration (sublimation of the impurities), discussed more fully below, whereby each frozen component will follow first the S-V solid line, back up until all the condensate mass becomes vapor if the resulting partial pressure is smaller than the triple point pressure, or until the triple point through the S-V line first, and then, further up in partial pressure trough the L-V saturation line, until all the accumulated mass of the impurity becomes finally vapor.

Figure 2A:
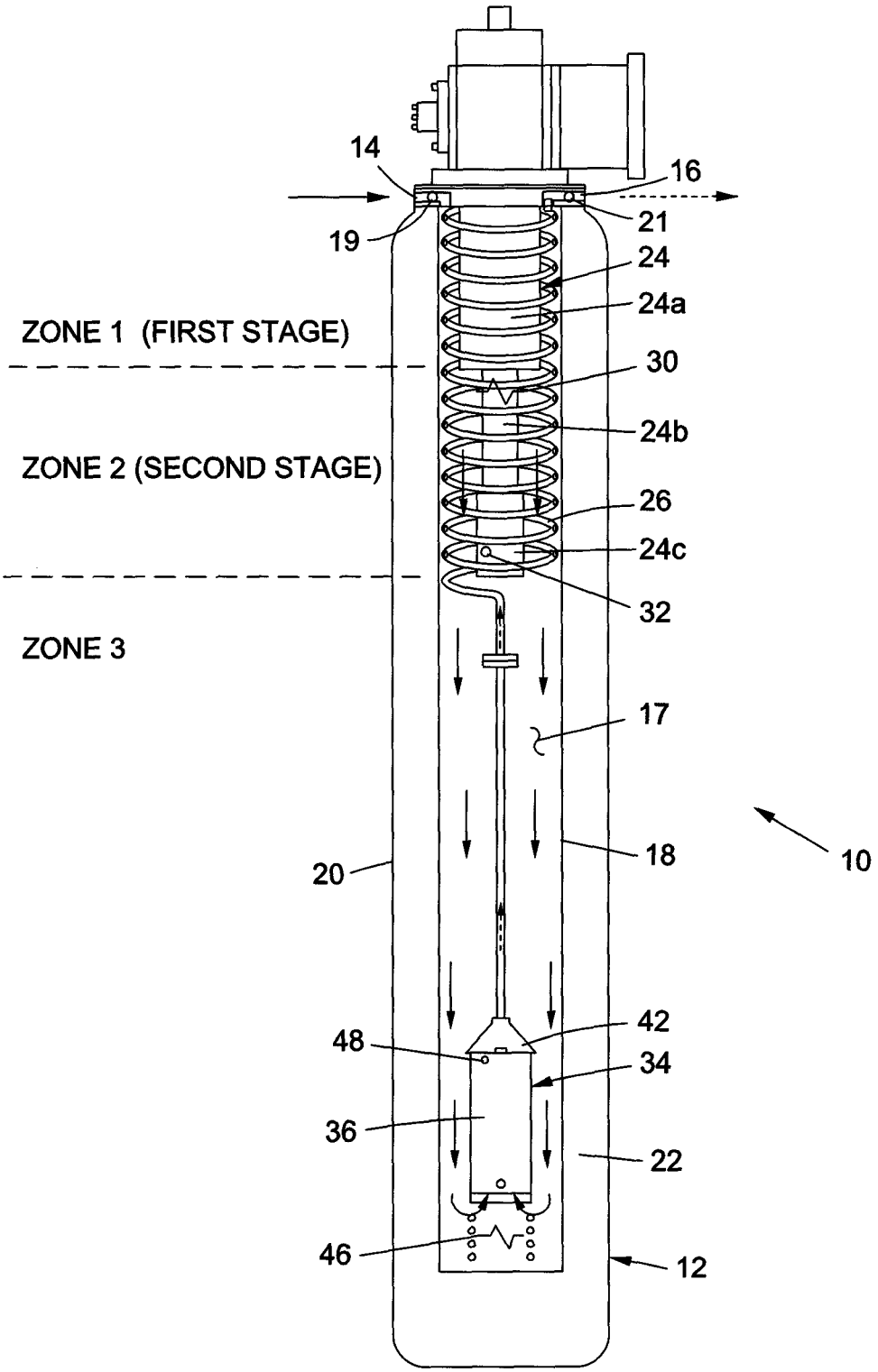
FIG. 2A is a cross-sectional view of a gas purifier apparatus constructed in accordance with a preferred embodiment of the present invention wherein the purifier apparatus is shown receiving an input of cryogen gas to be purified whereby the latter is shown cooling down from room temperature.
Figure 2B:
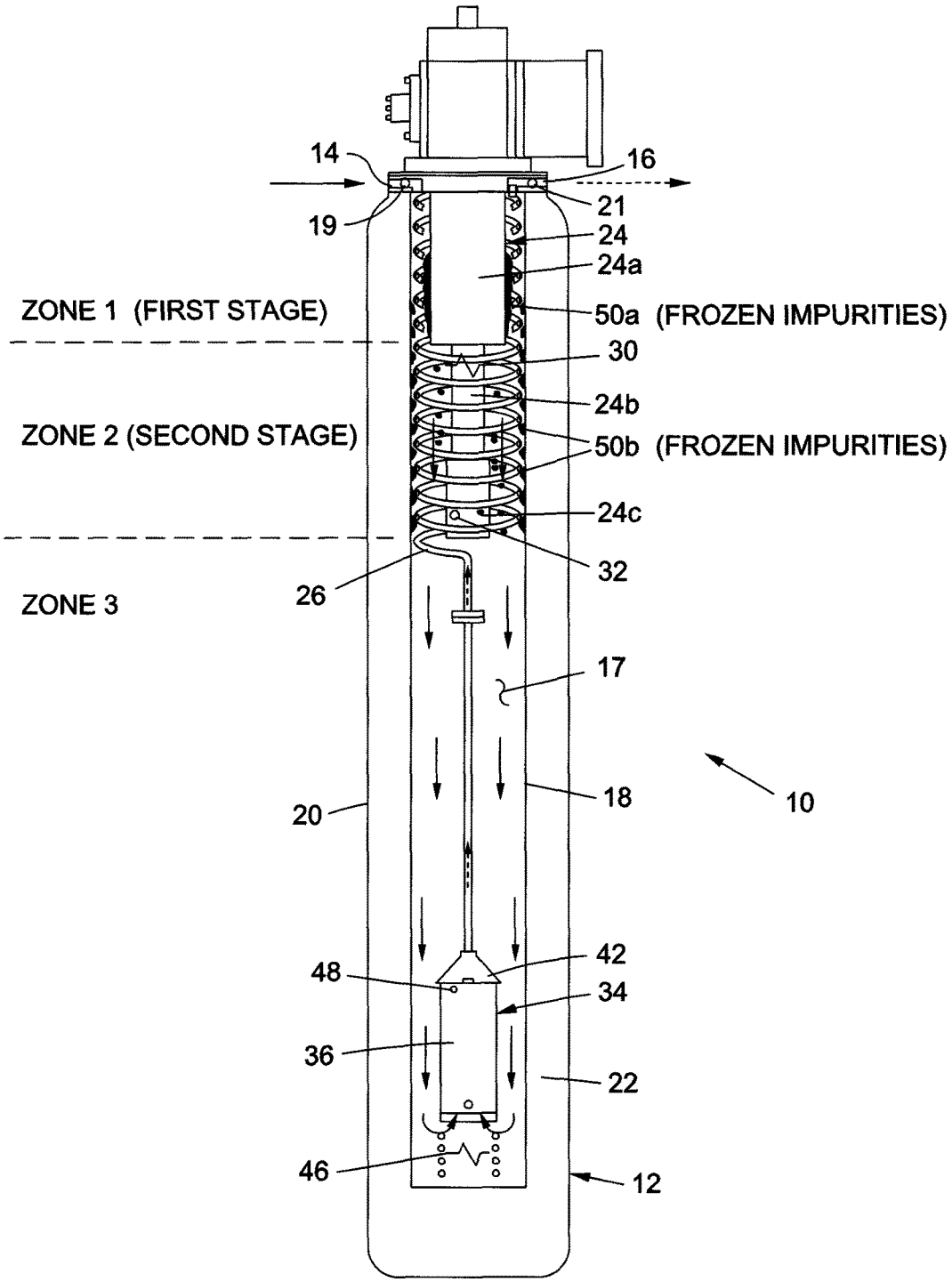
FIG. 2B is the cross-sectional view of the purifier apparatus of FIG. 2A wherein the cryogen gas is shown undergoing purification after initial cool down, such purification being reflected by a frost of de-sublimated impurities forming within the upper-most portion of the interior of the apparatus.

Referring now to FIGS. 2A-3B and 5, and initially to FIGS. 2A and 2B, there is shown an embodiment of a gas purifier or apparatus 10 for purifying gases as constructed in accordance with the present invention. As illustrated, the apparatus 10 is configured as a vertically-oriented housing, namely, a vertical vapor shielded helium Dewar 12 having an elongate, generally cylindrical configuration. With greater particularity, the Dewar 12 includes a gas inlet 14 for receiving a cryogen gas to be purified and a post-purification gas outlet 16. The gas inlet and outlets 14, 16 are disposed proximate the top end of the Dewar 12 as viewed from the perspective shown in FIGS. 2A-3B, with the gas inlet 14 fluidly communicating with an elongate, generally cylindrical interior chamber 17 of the Dewar 12. The interior chamber 17 is defined by an inner container 18 of the Dewar 12 which is concentrically nested within an outer container 20 thereof. A vacuum chamber 22 of the Dewar 12 is defined between the inner and outer containers 18, 20. Though not shown in the drawings, the Dewar 12 may also be outfitted with several radiation shields within prescribed interior regions thereof.

That portion of the interior chamber 17 disposed proximate the gas inlet and outlets 14, 16, which is commonly referred to as the "neck" of the Dewar 12, receives and accommodates a cooling device or coldhead 24 of the apparatus 10. The coldhead 24 includes three separate sections, including a first section 24*a*, a second section 24*b*, and a third section or cold tip 24*c*. In this regard, as labeled in FIGS. 2A-3B, the first section 24*a* of the coldhead 24 defines a first stage thereof, with the second and third sections 24*b*, 24*c* collectively defining a second stage thereof The coldhead 24 is a known component in the art, an example being a Gifford-McMahon (GM) two-stage closed cycle refrigerator (refrigerator compressor not shown). The first section 24*a* (i.e., the first stage) of the coldhead 24, in combination with a corresponding portion of the inner container 18, defines a first part of a deep cooling region within the interior chamber 17, labeled as Zone 1 in FIGS. 2A-3B. The second and third sections 24*b*, 24*c* (i.e., collectively the second stage) of the coldhead 24, in combination with a corresponding portion of the inner container 18, define a second part of the deep cooling region within the interior chamber 17, labeled as Zone 2 in FIGS. 2A-3B. That remaining portion of the interior chamber 17 extending below Zone 2 as viewed from the perspective shown in FIGS. 2A-3B and labeled as Zone 3 defines an impurities storage zone or region whereby frozen impurities are collected following de-sublimation thereof in Zones 1 and 2. As will be described with greater particularity below, also disposed within Zone 3 are hardware components necessary to provide an optional filtering system operative to ensure that any impurities, typically in their solid, de-sublimated form, do not become reintroduced into the purified cryogen gas stream generated by the apparatus 10 and methods of the present invention.

In a preferred implementation of the apparatus 10, the same is provided with a counter-flow heat exchanger 26. The heat exchanger 26 comprises an elongate, tubular segment of a material having prescribed thermal transmission characteristics which is coiled in the manner shown in FIGS. 2A-3B. In this regard, the heat exchanger 26 is formed in such that the outer diameter of the coils thereof is less than the inner diameter of the interior chamber 17 as allows the heat exchanger 26 to be advanced into the neck region of the Dewar 12, and in particular the interior chamber 17 thereof. At the same time, the inner diameter of the coils of the heat exchanger 26 is sized to circumvent the coldhead 24, thus allowing for the effective advancement of the coldhead 24 into the interior of the heat exchanger 26. As seen in FIGS. 2A-3B, in a preferred implementation, the heat exchanger 26 is sized relative to the coldhead 24 such that the outermost pair of coils is disposed generally proximate respective ones of the distal ends of the first and third sections 24*a*, 24*c*, the lowermost coil of the heat exchanger 26 thus being located at approximately the junction between Zones 2 and 3. However, those of ordinary skill in the art will recognize that this relative sizing between the coldhead 24 and heat exchanger 26 is exemplary only, and may be modified without departing from the spirit and scope of the present invention. In the apparatus 10, the upper end of the heat exchanger 26 terminating proximate the upper end of the first section 24*a* is fluidly coupled to the gas outlet 16.

In the apparatus 10, the lower end of the heat exchanger 26 proximate the third section 24*c* is defined by a straight portion which extends generally along the axis of the interior chamber 17. Along these lines, in accordance with a preferred fabrication method, the heat exchanger 26 is formed from the aforementioned elongate segment of tubular material stock, with one section thereof being coiled, and one section being maintained in a generally straight configuration.

The apparatus 10 further preferably comprises a first heater 30. The first heater 30 is electrically connected to a suitable power supply, and may be positioned between the coldhead 24 and the heat exchanger 26 proximate to the junction between the first and second stages, and hence Zones 1 and 2. In a preferred implementation, the first heater 30 may be wound onto portions of the coils of the heat exchanger 26 in the aforementioned location. The use of the first heater 30 will be described in more detail below. In addition, disposed on a prescribed location of the third section 24*c* or cold tip of the coldhead 24 is a sensor 32 (e.g., a thermal diode, thermometer). The sensor 32 electrically communicates with both the coldhead 24 and the first heater 30, and is operative to selectively toggle each between on and off states for reasons which will also be described in greater detail below.

As further seen in FIGS. 2A-3B, in accordance with the present invention, the lower end of the heat exchanger 26 as defined by the distal end of the straight portion thereof is fluidly coupled to a collection mechanism that is operative to receive purified cryogen gas within Zone 3 and transfer the same to gas outlet 16 via the heat exchanger 26 with de-sublimated impurities being left behind within Zone 3. The collection mechanism is disposed in Zone 3 and may simply include a device such as a funnel, font or other like device. In a preferred embodiment, the collection mechanism comprises a filter cartridge assembly 34 which is shown with particularity in FIG. 6.

The use of the filter cartridge assembly 34 as the collection mechanism, or as part of the collection mechanism, is optional within the apparatus 10. In FIGS. 2A-3B and 5, the apparatus 10 is depicted as including the filter cartridge assembly 34 as the collection mechanism. When viewed from the perspective shown in FIGS. 2A-3B, such filter cartridge assembly 34 is positioned within Zone 3 at a lower portion of the interior chamber 17 defined by Dewar 12. With greater specificity, the filter cartridge assembly 34 is positioned within the interior chamber 17 at an orientation sufficient to enable helium gas to be collected and passed therethrough, and thereafter through the heat exchanger and the gas outlet 16 in sequence, while leaving remaining de-sublimated and/or liquefied impurities within an impurities collection/storage region of Zone 3 as will be described in greater detail below.

Figure 6:
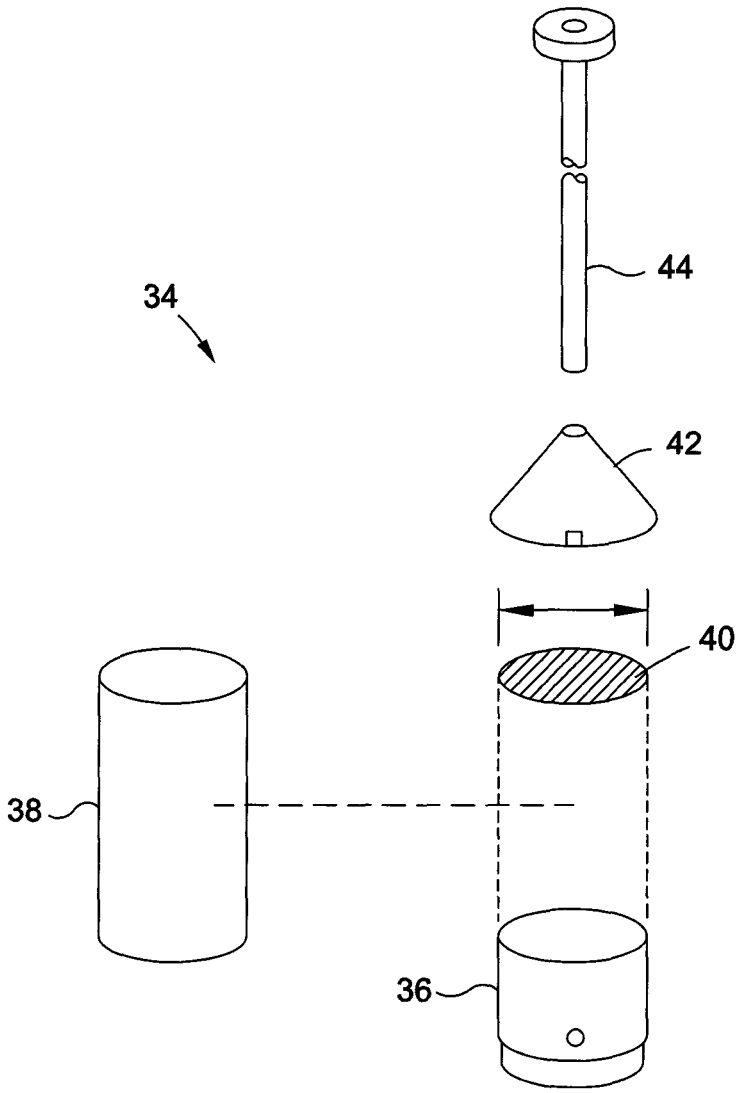
FIG. 6 is a partially-exploded view of a filter mechanism for use with the gas purifiers of the present invention as constructed in accordance with a preferred embodiment.

In the embodiment depicted in FIG. 6, the filter cartridge assembly 34 comprises a cylindrically configured, hollow collection member 36 into which the purified gas flows. After entering the collection member 36, the gas is passed through a filtering mechanism residing within the interior thereof. Exemplary filtering mechanisms which may be integrated into the filter cartridge assembly 34 include a bulk filter 38 or a thin layer filter 40, these filtering mechanisms being adapted to prevent impurities from being reintroduced within the cryogen gas sought to be purified through the use of the apparatus 10. The filter cartridge assembly 34 further comprises a funnel 42 which is attached to the collection member and effectively encloses the filtering mechanism therein. The funnel 42 is fluidly coupled to one end of an elongate, tubular outlet conduit 44 also included in the filter cartridge assembly 34. As seen in FIGS. 2A-3B, that end of the outlet conduit 44 opposite the end attached to the funnel 42 is fluidly connected to the heat exchanger 26, and more particularly to the distal end of the generally straight, non-coiled section thereof. The functionality of the filter cartridge assembly 34 (if included in the apparatus 10) based on preferred material selections for the particular filtering mechanism integrated therein will be described in more detail below.

The apparatus 10 further preferably comprises a second heater 46. The second heater 46 is also electrically connected to a suitable power supply and, when viewed from the perspective shown in FIGS. 2A-3B, is preferably positioned between the lower or bottom end of the interior chamber 17 and the filter cartridge assembly 34. Within the apparatus 10, this particular region of the interior chamber 17 adjacent to its lower end is characterized as the aforementioned impurities storage region thereof The use of the second heater 46 will also be described in more detail below. In addition, disposed on a prescribed location of the filter cartridge assembly 34 (if included) is a sensor 48 (e.g., a thermal diode, thermometer) which electrically communicates with the coldhead 24 and the first heater 30. The sensor 48 is operative to monitor the temperature of the filter cartridge assembly 34 for reasons which will be described in more detail below as well.

Having thus described the structural features of the apparatus 10, an exemplary method of using the same will now be described with reference to the FIGS. 2A-3B. FIGS. 2A and 2B depict the apparatus 10 receiving a cryogen gas to be purified at room temperature and during purification after initial cool down. The gas mixture enters Zone 1 through the gas inlet port 14 and is precooled by the first stage of the coldhead 24. The cooling of the gas mixture by the coldhead 24 is supplemented by the further cooling attributable to a direct heat exchange with the output gas flowing through the coils of the heat exchanger 26. As will be appreciated by those skilled in the art, the heat exchange facilitated by the heat exchanger 26 advantageously helps to minimize the cooling power extracted from the coldhead 24.

In accordance with a preferred embodiment, the incoming gas will be cooled to a temperature of 30 K or less, and preferably 10 K. In operation of the apparatus 10, the speed of the gas molecules for a typical input flow rate of 30 L/min decreases rapidly from a few cm/s down to 1-2 cm/min due to density increases. Some impurities in the gas introduced into Zone 1 via the gas inlet 14 may immediately reach super-saturation at some point down in Zone 1 and will start coating at least portions of the surfaces within that portion of the neck of the interior chamber 17. In greater detail, these frozen impurities (labeled as 50*a* in FIGS. 2B and 3B) may start coating portions of the first section 24*a* (i.e., the first stage) of the coldhead 24, one or more coils of the heat exchanger 26 which reside in Zone 1, and/or a corresponding portion of the inner container 18 which defines Zone 1. Thereafter, the gas mixture reaches Zone 2 where it is deep cooled down to a temperature at which all the remaining impurity components are de-sublimated and coat several different surfaces in Zone 2. In greater detail, these remaining frozen impurities (labeled as 50*b* in FIGS. 2B and 3B) coat at least portions of the second and third sections 24*b*, 24*c* (i.e., the second stage) of the coldhead 24, one or more coils of the heat exchanger 26 which reside in Zone 2, and/or a corresponding portion of the inner container 18 which defines Zone 2.

Figure 3A:
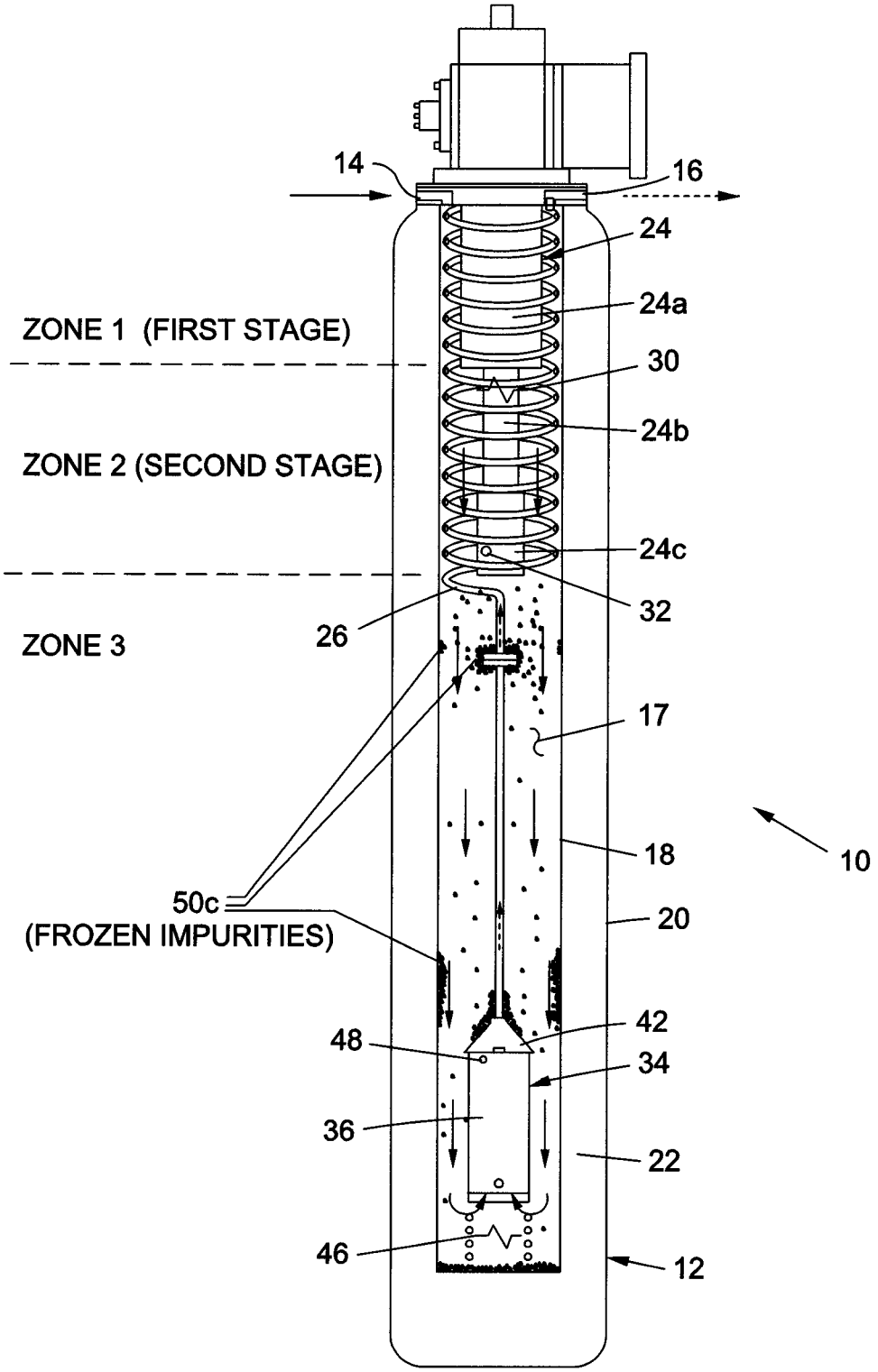
FIG. 3A is the cross-sectional view of FIGS. 2A and 2B wherein the purifier is shown undergoing a "soft" regeneration process.

In order for the apparatus 10 to run in as continuous a manner as possible such that minimal time and effort are expended to dislodge or otherwise transfer the de-sublimated impurities 50*a*, 50*b* collected within Zones 1 and 2, the present invention further contemplates regeneration processes, and more particularly a "soft" regeneration process, operative to remove such impurities 50*a*, 50*b* from Zones 1 and 2 to the aforementioned impurities storage region of Zone 3. FIG. 3A illustrates the apparatus 10 as effectuating such "soft" regeneration (i.e., sublimation) process. As shown, the coldhead 24 is deactivated and first heater 30 concurrently activated until the third section 24*c* or cold tip of coldhead 24 reaches the sublimation and/or liquefaction temperature of the frozen impurities 50*a*, 50*b* in Zones 1 and 2. This causes the frozen impurities 50*a*, 50*b* to sublimate and/or liquefy, and fall down towards the impurities storage region of the interior chamber 17. As they fall, the impurities are again subjected to low de-sublimation temperatures. Since the impurities are again supersaturated in the gas mixture, they consequently are again frozen (such re-frozen impurities being labeled as 50*c* in FIGS. 3A and 3B), and may adhere to surfaces within Zone 3 and/or finally fall down into the impurity storage region. During the regeneration process, which can be repeated as often as needed, the temperature in the lower portion of Zone 3, including the temperature of the filter cartridge assembly 34 therein, does not change substantially as its temperature remains less than 20 K, while the temperature of the third section 24*c* of the coldhead 24 rises up to 90-100 K, ensuring complete sublimation/liquefaction of impurities within Zones 1 and 2.

Along those lines, during the regeneration or sublimation process, the temperature of the filter cartridge assembly 34 is monitored via sensor 48. It is contemplated that the regeneration process will be interrupted (the first heater 30 deactivated and the coldhead 24 reactivated) if the temperature of the filter cartridge assembly 34 starts to approach 30 K, to thus guarantee that the impurities level at the gas output 16 remains negligible (less than 0.05 ppm). In this regard, it is desirable that the temperature in at least the lower portion of Zone 3 remains at or below the de-sublimation temperature of the impurities to insure that no sublimated impurities resulting from the regeneration process contaminate the gas flowing into the cartridge filter assembly 34 and thereafter to the gas outlet 16 via the heat exchanger 26. As a consequence of the very high efficiency of the heat exchanger 26, it is almost always free of frost and condensates, resulting in the temperature of the filter cartridge assembly 34 (which is fluidly coupled to the heat exchanger 26) typically remaining in the range of 5 K-20 K. Optionally, the exterior surface of the coldhead 24 and/or that of the heat exchanger 26 may be coated with an ice resistant material so that the solid impurities and frost are repelled by the resulting slippery coated surfaces and directly fall down into the impurities storage region, thus minimizing the frequency of the regeneration processes.

This "soft" regeneration process, which was derived from finding that the impurities are frozen and collected in Zones 1 and 2, is nothing less than a cleaning process for the coldhead 24 during which the coldhead 24 is "OFF" and first heater 30 is "ON." This process displaces the impurities 50*a*, 50*b* down into Zone 3, thus cleansing the heat exchanger 26 and the coldhead 24 that therefore recovers its cooling capacity. Several processes of this kind can be done at regular intervals of time, or when considered necessary, to increase the purifying time period between two regenerations.

More particularly, as indicated above, it is contemplated that the initiation of the "soft" regeneration process can be facilitated in any one of several different ways. One way could be based on process initiation automatically at prescribed, timed intervals (e.g., once a day). Another could be based on the functionality of the sensor 32 attached to the third section 24*c* or cold tip of the second stage of the coldhead 24. As indicated above, the sensor 32 is preferably a thermal diode or thermometer which electrically communicates with both the coldhead 24 and the first heater 30. The efficacy of the apparatus 10 is premised, in large measure, on its thermal stability. Along these lines, when the temperature of the cartridge assembly 34 reaches a minimum threshold and starts to increase, this often means that the efficiency of the coldhead 24 and the heat exchanger 26 is being degraded, thus compelling the need for the initiation of the soft regeneration process. The sensors 32, 48, working in concert with each other, effectively monitor the thermal stability of the apparatus 10, with the sensor 32 being operative to selectively toggle the coldhead 24 and the first heater 30 between on and off states as may be needed to facilitate the initiation of the soft regeneration process. Along these lines, it is also contemplated that the sensor 32 may be operative to terminate any regeneration process by deactivating the first heater 30 and reactivating the coldhead 24 once it senses that the temperature in Zones 1 and 2 has reached the highest sublimation temperature of the specific impurities within the gas entering the interior chamber 17 via the gas inlet 14.

Figure 4A:
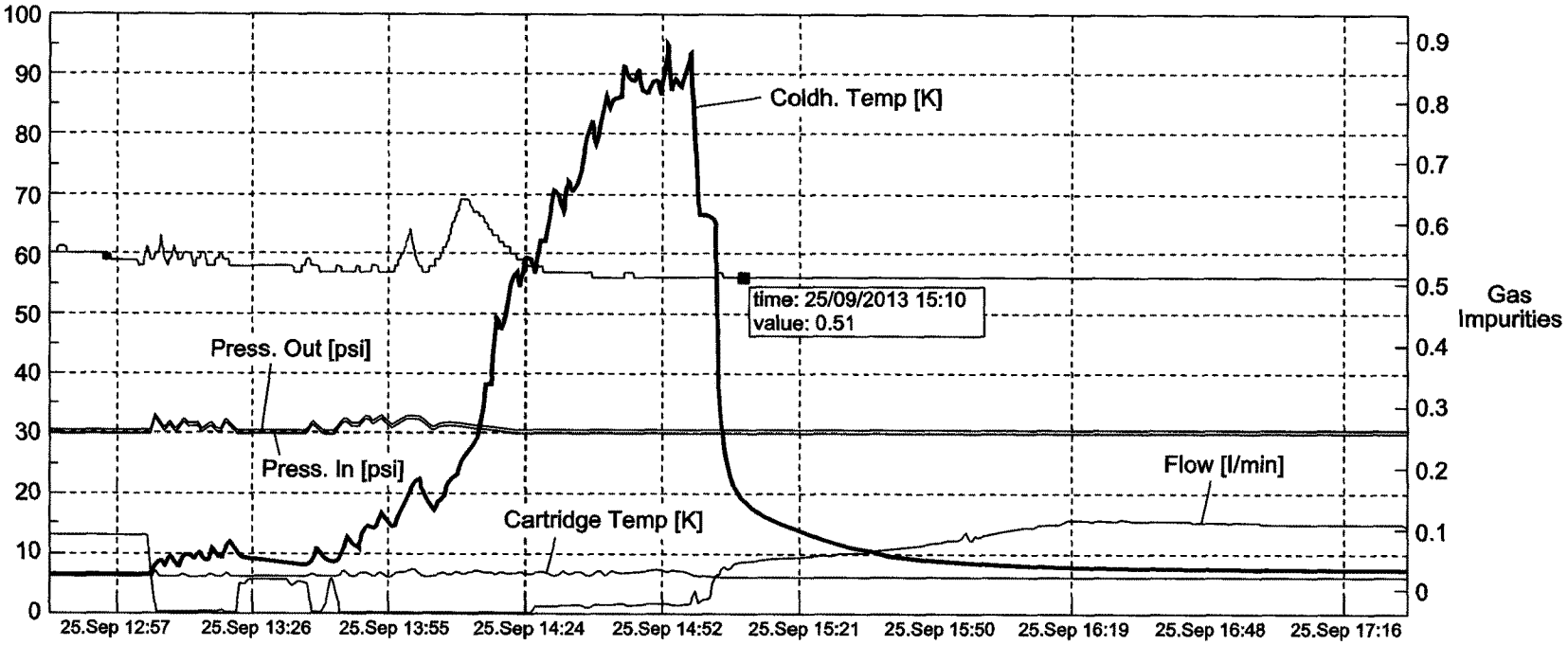
FIG. 4A is a graph depicting fluctuations of several parameters (e.g., flow rate, incoming pressure, outgoing pressure, and temperatures as a function of time during an impurity de-sublimation process.

In less common circumstances, an excessive amount of build-up of frozen impurities 50*c* in Zone 3 could create a partial blockage within the interior chamber 17 as gives rise to a pressure drop between the gas inlet 14 and the gas outlet 16. In this regard, it is contemplated that the apparatus 10 may also be outfitted with two pressure sensors, one which is operative to monitor inlet pressure within Zones 1 and 2, and the other which is operative to monitor outlet pressure at the gas outlet 16 fluidly communicating with the heat exchanger 26. In an exemplary embodiment, these two pressure sensors labeled as 19 and 21 in FIG. 2A, are positioned such that the pressure sensor 19 is located at and fluidly communicates with the gas inlet 14, with the pressure sensor 21 being located at and fluidly communicating with the gas outlet 16. In the event the aforementioned pressure drop is detected by these pressure sensors based on a comparison of the pressure in Zones 1 and 2, and the pressure in the heat exchanger 26 (which would be commensurate to the reduced pressure in Zone 3 attributable to the complete or partial blockage therein), the pressure sensors could be used to trigger the regeneration process. The pressure sensors would further be operative to thereafter discontinue such regeneration process upon sensing that the previously imbalanced pressure levels have equalized within the apparatus 10. An exemplary illustration of this functionality is graphically depicted in FIG. 4A.

Figure 3B:
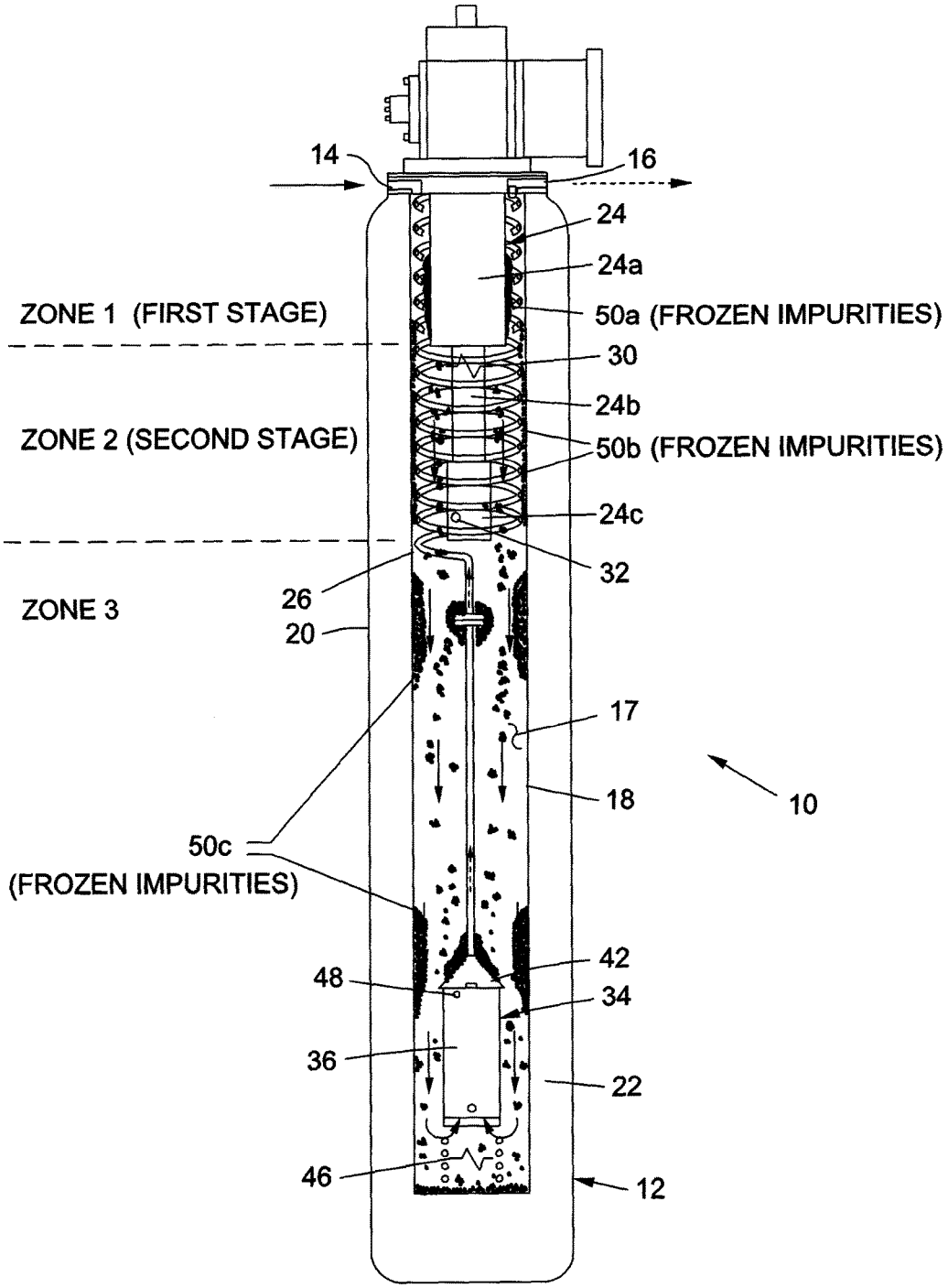
FIG. 3B is the cross-sectional view of FIGS. 2A-2B and FIG. 3A wherein the purifier is shown purifying a gas after a sublimation/impurity displacement process.

The soft regeneration process (cleansing of the coldhead 24) allows for an extension in the periods between high T (150 K) regenerations, therefore allowing the purifying periods to be much longer. The ability to use the soft regeneration is attributable, at least in part, to the high available volume in Zone 3 (especially when using a small filter cartridge assembly 34), and thus the higher available volume to collect frozen impurities displaced from Zones 1 and 2. Moreover, the fact that Zone 3 remains very cold as indicated above ensures that the purity at the gas output 16 is not affected by the sublimation process, so that the apparatus 10 continuously feeds the liquefiers or any device connected at its output. In this regard, FIG. 3B represents the situation in which, after a regeneration process, impurities are stored in Zone 3 and new impurities are being desublimated in Zones 1 and 2.

When the amount of impurities collected in solid form in Zone 3 is estimated to be of the order of the "belly" volume (i.e., available volume in the impurities storage region), or when any blockages caused by frost are frequent and cannot be eliminated by the "soft" regeneration or sublimation processes, the apparatus 10 must necessarily be subject to a more robust regeneration process. To accomplish this objective, the second heater 20 in the impurities storage region may be activated, and used to sublimate, liquefy, and evaporate the stored impurities (labeled as 52 in FIG. 5). Heating the whole system to about 120-150 K guarantees that all the stored impurities 52 are evaporated, with the inner container 18 thereafter being evacuated with a pump and refilled again with a gas mixture to start a new purification cycle. In this regard, and for sake of clarification, the first and second heaters 30, 46 are necessary in the practice of the present invention; first heater 30 in the deep cooling region for performing the "soft" regeneration, and second heater 46 in the bottom of the Dewar 12 or impurities storage region for additional heating during the standard high T regenerations.

The "soft" regeneration method, however, cannot be implemented with any embodiments designed for coalescing impurities, as some prior art systems such as those disclosed in U.S. patent application Ser. No. 13/937,186, entitled CRYOCOOLER-BASED GAS SCRUBBER, filed on Jul. 8, 2013. Notwithstanding, in a new embodiment using the small filter cartridge assembly 34, it is possible to implement such method. The method provides for a huge improvement in the art, since the coldhead 24 and heat exchanger 26 both maintain efficiency unaltered, and the down time for removing impurities can be dramatically reduced. In fact, by adequate design of the interior of the Dewar 12, it is possible to store impurities during very long periods, potentially as long as the maintenance period of the coldhead 24.

As previously explained, in certain embodiments of the present invention, it is contemplated that the filter cartridge assembly 34 may be integrated into the collection mechanism of the apparatus 10 and operative to ensure that any of the impurities held within Zone 3 or the impurities storage region do not somehow become reintroduced into the purified cryogen gas stream that is ultimately collected from Zone 3 and passed upwardly through the Dewar 12 for reuse once output from the gas outlet 16. The filter cartridge assembly 34 integrated as part of the apparatus 10 and as described above is specifically designed to have a compact, thin profile that not only provides exceptional filtering capability, but eliminates the large, excessively bulky wool glass cartridge designs typically in use.

In operation of the apparatus 10 as outfitted with the filter cartridge assembly 34, the purified gas (e.g., helium) is introduced into the collection member 36 of the filter cartridge assembly 34 and thereafter passed through its filtering mechanism, i.e., the bulk filter 38 or thin layer filter 40. After passing through either of these filtering mechanisms, the purified gas passes through funnel 42 and upwardly through outlet conduit 44, and ultimately passes to gas outlet 16 via heat exchanger 26. In the embodiment shown, the filter mechanisms represented by the bulk filter 38 and the thin layer filter 40 represent two alternative types of filtering means, with bulk filter 38 representing a prior art glass wool or fiberglass-based filtering mechanism that is operative to provide sufficient surface area to trap any impurities that might otherwise become reintroduced into the cryogen gas. In the alternative, the thin layer filter 40 represents a thin layer of material having a plurality of micrometer-sized holes through which the gas is filtered. Such the thin layer filter 40, discussed more fully below, may preferably be formed from a metallic mesh material or may be formed from nylon mesh, the latter being preferred.

With greater particularity, a very small 2D nylon mesh filter used as the thin layer filter 40 plays the same role than a big wool glass cartridge and gives much more room available for storing impurities during the necessary and very important soft regeneration processes to maintain the efficiency of the heat exchange during long periods of time. In fact, it is presently believed that there is not necessarily a need for a wool glass cartridge typically constituting the bulk filter 38, as use of a filter cartridge assembly 34 outfitted with the thin layer filter 40 is functional in a manner wherein impurities at the level of 0.1 ppm never arrive to the gas outlet 16 when such filter cartridge assembly 34 is placed near the bottom of the Dewar 12. The filter cartridge assembly 34 can accommodate different micrometer size thin layer filters 40 that can be used to avoid dragging of impurities towards the gas outlet 16. In this regard, it is contemplated that a single or a combination of planar nylon and/or metallic mesh discs having a hole size ranging from 1-25 μm and a diameter of approximately 25 mm can be utilized with the nylon mesh having hole sizes ranging from 1-25 μm and the stainless steel mesh having a 25 μm hole size. Other types of materials and hole sizes would be readily understood by those skilled in the art and readily integrated in the practice of the present invention.

Those of ordinary skill in the art will recognize that the size and/or shape of the filter cartridge assembly 34 as shown in FIGS. 2A-3B and 5 may vary (e.g., may be smaller than that depicted) without departing from the spirit and scope of the present invention. In this regard, the overall size and shape will be dictated, to at least some degree, by the selection of the particular filtering mechanism that is to be integrated therein. Irrespective of the specific size or shape of the filter cartridge assembly 34, it is contemplated that the annual gap defined between the circumferential surface thereof of greatest diameter and the inner diameter of the inner container 18 will be sufficient to allow for the desired flow of sublimated impurities into the impurities storage region and the flow of purified gas into the underside of the collection member 36.

Prototype Development and Test Results

A prototype apparatus built with the purpose of verifying the invention ideas, was implemented using a two stage coldhead of 1.5 W cooling power at 4.2 K, placed in the neck of a Helium Dewar of 10 L capacity, similar to prior art systems. The apparatus had a heater wound on top of an output heat exchange tube, and a sensor attached in said tube, just below the cold tip of the coldhead second stage, to implement in a controlled manner the sublimation/displacement of solid impurities trapped on the deep cooling region, i.e., in the Dewar neck region. The sublimation/displacement process consisted of stopping the coldhead and activating the heater for about 10-60 minutes until the cold tip sensor indicated 100 K, a temperature at which the collected impurities in Dewar neck region are sublimated/liquefied, and transported to the impurities storage region, i.e., to the Dewar bottom.

By performing periodic sublimation/displacement cycles of the solid impurities from the deep cooling region to the storage region, the efficiency of the heat exchanged between the input gas flow, the coldhead, and the output gas through the heat exchanger was maintained nearly optimal at any time. Thus, the prototype was operative to purify from $10^6$ to $10^7$ sL of Helium gas containing from 100 ppm to 1000 ppm total volume ratios of $N_2$ and $O_2$, without interruption for regeneration. Output flow rate peaks as large as 50 sL/min, and average flow rates in excess of 30 L/min, could be maintained with sufficiently long periods of time (>12 hours) between soft regenerations, without affecting the output purity of the processed gas. The whole apparatus and its components could be scaled in size and power for higher flow rates.

Filter Assembly

As revealed in the testing of the prototype, there is strong evidence that the role of a glass wool cartridge serving as the filtering mechanism is confined to avoiding possible dragging of solid impurities only when sudden high output flow rates develop (>30 L/min). The thermodynamics of gas mixtures also indicated that impurities are totally frozen until the level corresponding to the vapor pressure and temperature on the coldhead deep cooling region located on the upper part of the Dewar. This leads to the conclusion that the size of the filter cartridge assembly is not necessarily of importance in the purification process, with the smaller size the better. Thus, as indicated above, a simple small planar 2D filter in the micrometer range size serving as the filtering mechanism in the filter cartridge assembly could potentially perform the same role as any glass wool cartridge of any size serving as the filtering mechanism.

To demonstrate it experimentally, there was built a very small canister in which a single or a combination of planar Nylon and/or metallic mesh discs, having different hole sizes in the micrometer scale range (1, 5, 10, 25 μm) and a diameter of 25 mm were installed. Used were Nylon mesh discs with 1, 5, and 10 μm hole sizes, and stainless steel mesh disc for the 25 μm hole size. Also added were two 25 mm diameter stainless steel grids with 1 mm holes, one on each side of the 2D pancake filtering device, to provide mechanical strength against pressure differences. The design allowed for simple exchange of the meshes for easy testing of different combinations if necessary.

Figure 4B:
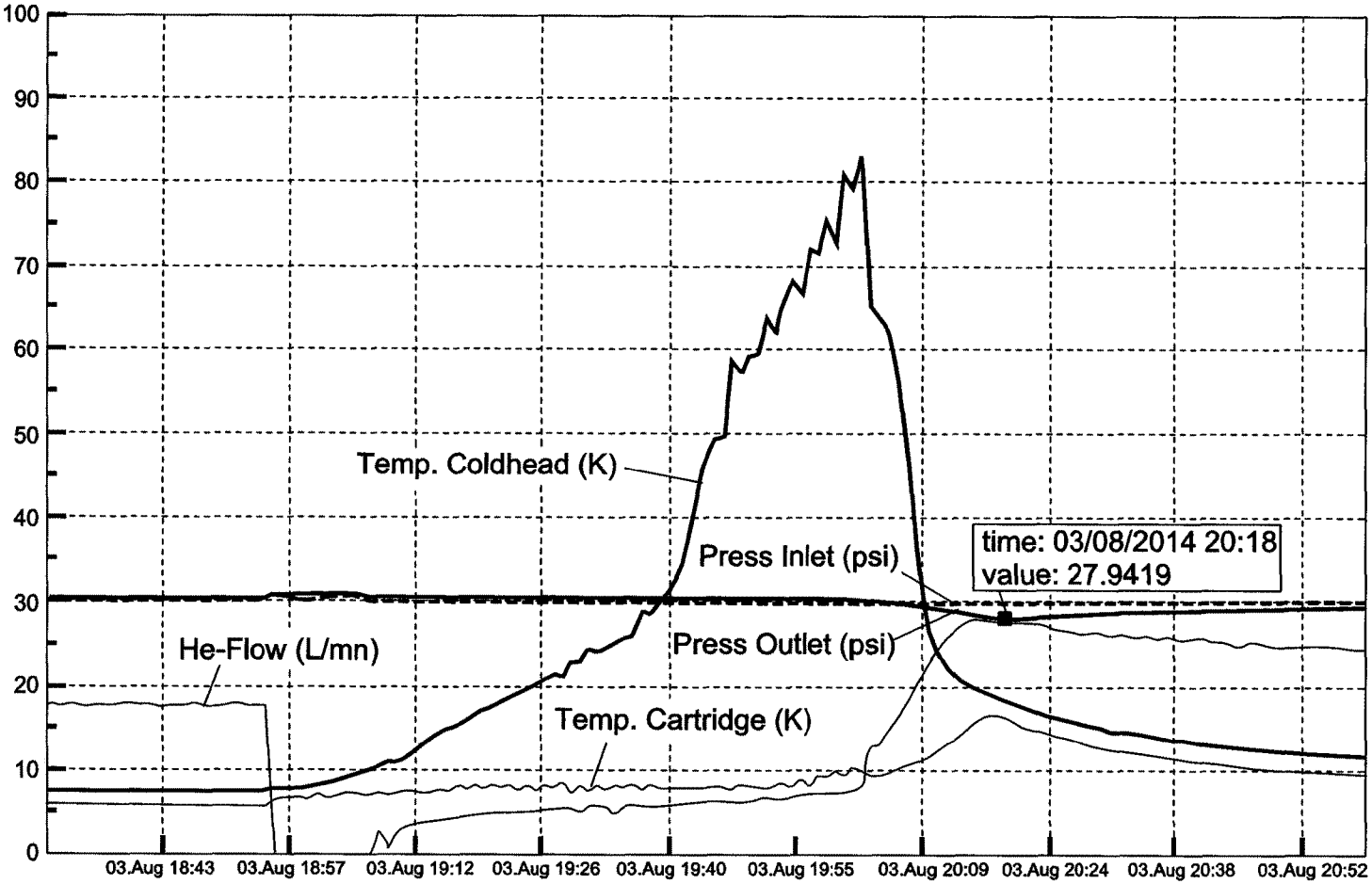
FIG. 4B is a graph depicting exemplary fluctuations of several parameters (e.g., flow rate, incoming pressure, outgoing pressure, and temperatures) as a function of time during an impurity de-sublimation process occurring during a soft regeneration.
Figure 4C:
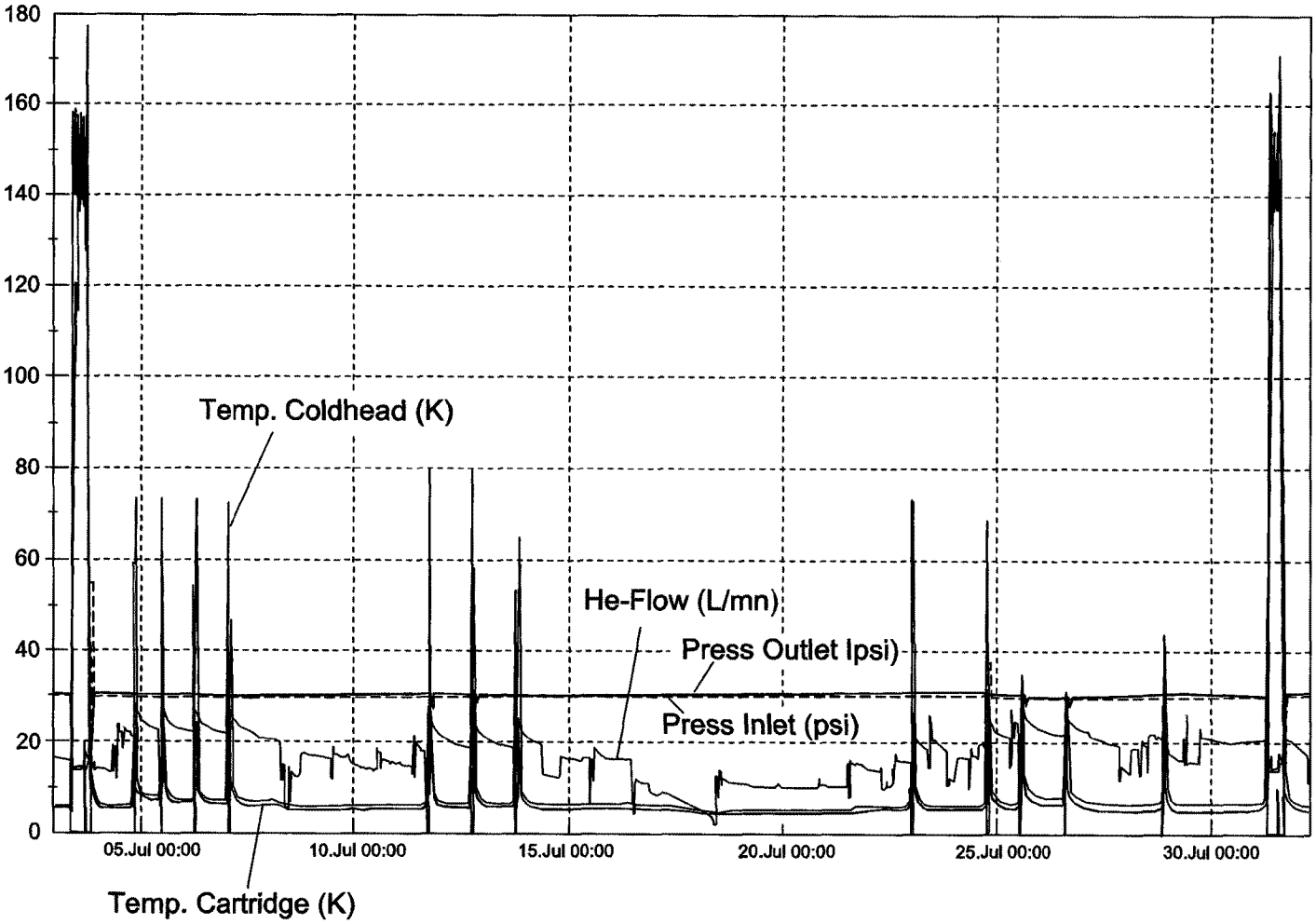
FIG. 4C is a graph which is representative of a month of operation of a prototype of the present invention between two $N_2$ regenerations (140K) during which the system automatically performed 11 soft regeneration processes.
Figure 5:
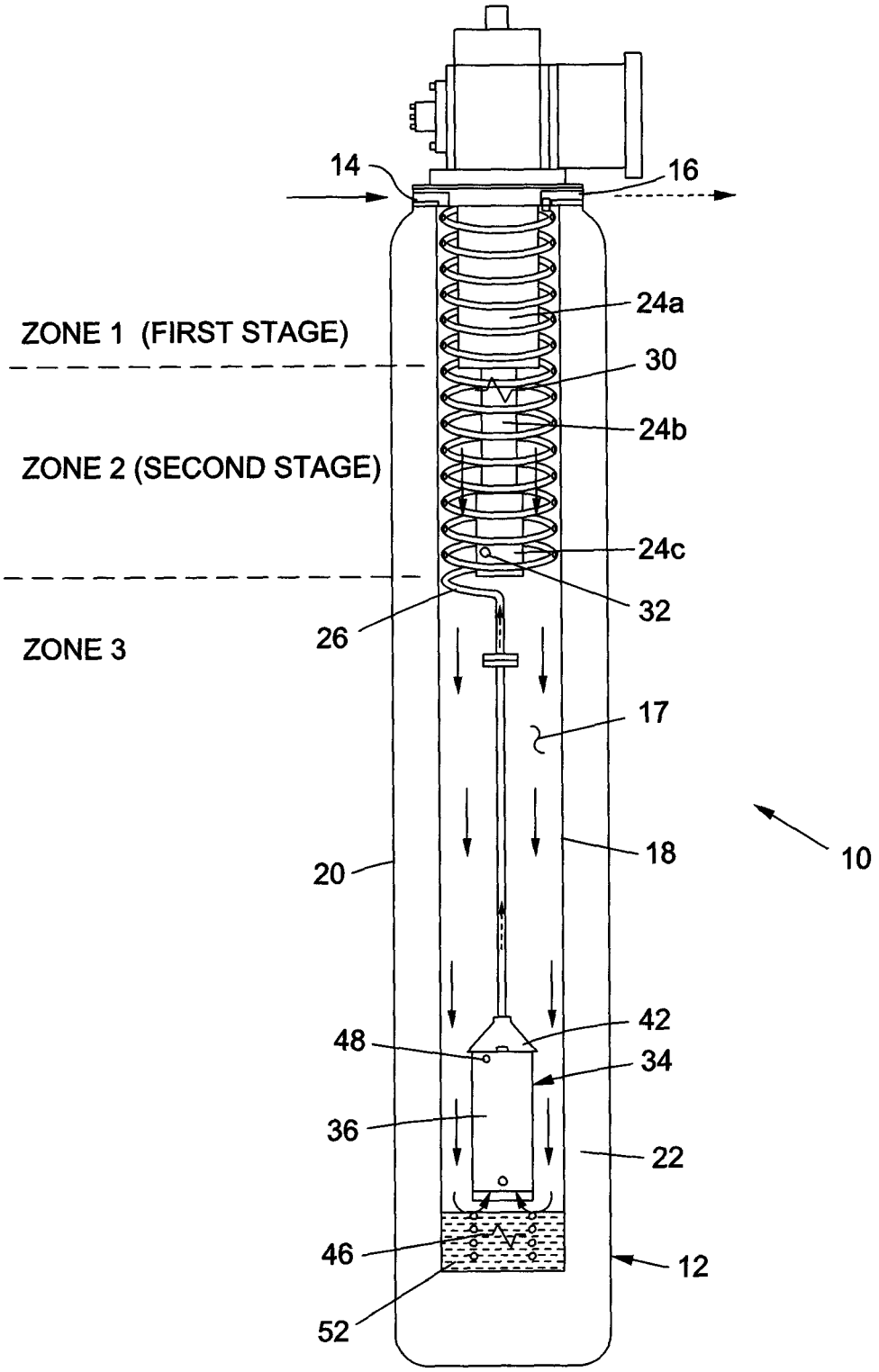
FIG. 5 is the cross-sectional view of FIGS. 2A-2B and 3A-3B wherein the purifier is shown undergoing a regeneration process as accomplished by the combined effort of first and second heaters operative to displace impurities from a de-sublimation area to an impurities storage area (heater 1) and ultimately liquefied and evaporated (heater 2) through a vent valve opened to the atmosphere.

Referring to FIG. 4C, after 30 days of operation, a total of 1,000,000 L, having an average impurity concentration of 300 ppmV, were purified. About 300 cc of solid impurities were collected (1,000,000 L*300 ppms of impurities/$10^6$=300 L of gas impurities=>300 L(gas)/1000 (L(gas)/L (solid))=0.300 L(solid)=300 cc (solid)). During such period, starting and ending with standard air regenerations (140 K), eleven soft regenerations were automatically performed by the system. It is clear that soft regenerations for that level of impurities (300 ppmV) are only necessary when the incoming gas flow exceeds 20 L/min.

During that period many automatic soft regenerations were performed by the system. Those processes were launched as soon as the lost of efficiency was detected by the increase of the canister temperature. FIG. 4B is a graph depicting exemplary fluctuations of several parameters (e.g., flow rate, incoming pressure, outgoing pressure, and temperatures) as a function of time during an impurity desublimation process occurring during a soft regeneration. The data is very clean, thus clearly establishing the correlation between coldhead space T and a small pressure drop (incoming pressure minus outgoing pressure) appearing during the cool down. This is of the order of 0.1 psi/L/min and becomes negligible as soon as coldhead space T is below 20 K, when the molar volume of the solid impurities reaches a minimum constant value. Since this is a limit situation equivalent to that having 2 ATLs 160 connected to the ATP in FAST mode (24 L/min flow rate), it was concluded there was no need to reduce the gas flow impedance of the prototype. Along these lines, the small observed pressure drop is not believed to be attributable to the filter assembly within the system, but occurs in the deep cooling region and is the result of the volume change of the solid impurities with temperature. In any event, it will be apparent for those of ordinary skill in the art that a gas flow impedance reduction could be easily implemented when necessary, e.g. by increasing the available space for solid impurities in the coldhead deep cooling space (zones 1 and 2) and/or above the canister (zone 3), since those are the zones where the pressure drop takes place and not on the output filter nor on the interior of the heat exchanger exhaust tube.

Furthermore, this effect also limits the output flow and can be used, together with the corresponding T increase, as a double check for the system to decide when to perform a soft regeneration. Furthermore, if a pressure drop develops while the filter is at a temperature below 10 K, it will indicate that clogging is starting to be produced in the coldhead deep cooling space (zones 1 and 2) or on the impurities storage region (zone 3) and a standard regeneration should be performed.

With the 2D filter there is also much more room available for the pure cold He phase in zone 3, than in prior art, thus allowing transients of high flow (>30 L/min) at the output during much longer time before the thermal stability is lost.

Foreseeable Modifications

At present, it is believed that a number of minor, foreseeable modifications with respect to previous art may be made to enhance the practice of the present invention as presently disclosed. For example, a bypass valve to maintain a minimum input flow of 5 L/min when there is no flow demand at the output may not be necessary. In fact partial clogging-unclogging on the deep cooling region may appear spontaneously, even with continuous input-output flows above 10 L/min, but only for high impurities concentration. A soft regeneration would be sufficient to periodically eliminate this problem and there would be no need for a heater on the 2D filter output device. In fact, there is contemplated future improvements wherein the filter may be thermally anchored to the Dewar bottom so that the filter sensor also senses the temperature (T) of the bottom for the low temperature regenerations to be performed, maintaining the heating until the liquid phase of the impurities is completely evaporated, as in the prior art (Quantum Designs ATP model), such as that described in U.S. patent application Ser. No. 13/937,186 entitled CRYOCOOLER-BASED GAS SCRUBBER filed Jul. 8, 2013.

It is further contemplated that only this filter/Dewar bottom sensor may be all that is strictly necessary since, as demonstrated in the testing, the soft regenerations can be controlled only with the filter temperature that should never exceed 30 K. The size/power of the coldhead is of importance to guarantee larger maximum flow rates during longer periods of time before each soft regeneration.

Accordingly, additional modifications and improvements of the present invention may also be apparent to those of ordinary skill in the art. Thus, the particular combination of parts and steps described and illustrated herein is intended to represent only certain embodiments of the present invention, and is not intended to serve as limitations of alternative devices and methods within the spirit and scope of the invention.

What is claimed is:

1. A gas purifier for removing gaseous impurities from a cryogen gas comprising:

a housing having an inlet for receiving a cryogen gas to be purified and a purified gas outlet, said housing defining a hollow interior which defines a first region in an uppermost interior portion thereof and a second region in a lower interior portion thereof;

a coldhead disposed in the first region and operative to contact a flow of the cryogen gas sought to be purified received through the inlet, the coldhead being operative to cool the cryogen gas to a temperature sufficient to de-sublimate at least one gaseous impurity present in the cryogen gas;

a heat exchanger disposed in the first region of the interior of the housing and connected to the purified gas outlet, the heat exchanger comprising an elongate, tubular segment which coils around the coldhead;

a heater disposed within said first region of the interior of the housing, the heater being operative to cause sublimation of the at least one impurity de-sublimated in the first region, the heater being positioned between the coldhead and the heat exchanger; and a collection mechanism coupled to the purified gas outlet, the collection mechanism being disposed within the second region and selectively positioned therein such that the cryogen gas passes therethrough, flowing from the second region towards the first region, and through the outlet while retaining the at least one de-sublimated impurity within the interior of said housing, the collection mechanism being connected to the heat exchanger;

the heater and the coldhead being adapted for cooperative use in a first mode wherein the heater is activated and the coldhead is deactivated to cause sublimation of the at least one impurity de-sublimated in the first region;

the heater and the coldhead further being adapted for cooperative use in a second mode wherein the heater is deactivated and the coldhead is reactivated to maintain the temperature of the collection mechanism below a predetermined maximum temperature;

wherein:

the second region of the interior of the housing includes at least one surface to retain the at least one de-sublimated impurity formed in the first region;

the housing comprises a vertically-oriented Dewar; and the collection mechanism includes a filter mechanism comprising a sheet of metallic wire mesh;

the gas purifier further comprises at least one first sensor disposed within the interior of the Dewar in the first region and in operative communication with the coldhead and the heater, the coldhead and the heater being operative to selectively activate and deactivate to transition between the first and second modes in response to information received from the at least one first sensor;

the collection mechanism further comprises a filter cartridge assembly and at least one second sensor disposed on said filter cartridge assembly and in operative communication with the coldhead and the heater, the at least one second sensor being operative to monitor the temperature of said filter cartridge assembly as the cryogen gas flows from the second region towards the first region; and the at least one first sensor and the at least one second sensor being configured to monitor changes in temperature within the purifier as the cryogen gas flows from the second region toward the first region through the collection mechanism.

2. The gas purifier of claim 1 wherein the metallic wire mesh includes a plurality of micropores formed therein, the micropores having a size ranging from 1 to 25 micrometers.

3. The gas purifier of claim 1 further comprising a second heater disposed within the second region of the interior of the Dewar, the second heater being operative to liquefy and facilitate evaporation of the at least one de-sublimated impurity disposed within the second region of the interior of the Dewar.

4. The gas purifier of claim 1 wherein the cryogen gas sought to be purified is helium and the at least one impurity comprises oxygen.

5. The gas purifier of claim 4 wherein the at least one impurity further includes nitrogen.

6. The gas purifier of claim 1 further comprising:

a first pressure sensor in communication with the inlet to measure an inlet pressure of cryogen gas flowing through the inlet, and a second pressure sensor in communication with the outlet to measure an outlet pressure of the cryogen gas flowing through the outlet.

7. The gas purifier of claim 6 wherein the metallic mesh defines a plurality of apertures having an aperture size from 1 micrometer to 25 micrometers.

8. The gas purifier of claim 6 wherein the cryogen gas comprises helium and the gaseous impurities comprise oxygen and nitrogen.

9. The gas purifier of claim 6, wherein the first region defines a first zone formed within an uppermost portion of the interior chamber and a second zone formed adjacent to the first zone, and the second region defines a third zone disposed below the second zone within a lowermost portion of the interior chamber, the gas purifier further including a second heater disposed within the third zone of the interior chamber of the Dewar, the second heater being operative to liquefy and facilitate the evaporation of the de-sublimated impurities collected within the impurities storage region of the third zone.

10. The gas purifier of claim 1, wherein the filter cartridge assembly includes a funnel and an outlet conduit extending therefrom.

11. The gas purifier of claim 1, wherein the housing defines a longitudinal axis, the sheet of metallic wire mesh extending perpendicular to the longitudinal axis.

12. The gas purifier of claim 11, wherein the sheet of metallic wire mesh includes a mesh disc.

* * * * *